US005533651A

United States Patent [19]

Eddy et al.

[11] Patent Number: 5,533,651

[45] Date of Patent: Jul. 9, 1996

[54] UNIVERSAL ADAPTER FOR LIQUID DISPENSERS

[76] Inventors: John W. Eddy, 6581 Valley Dr., Riverside, Calif. 92505; David F. Hutchinson, 601 Potrero Grande Dr., Monterey Park, Calif. 91755-7407; Kelly S. Needham, Sr., 6045 Avenida Barcelona, Yorba Linda, Calif. 92687

[21] Appl. No.: 353,889

[22] Filed: Dec. 12, 1994

[51] Int. Cl.[6] ..... B65B 3/04

[52] U.S. Cl. ..... 222/185.1; 141/364

[58] Field of Search ..... 222/185, 181, 222/146.1, 146.6, 185.1, 181.1; 141/329–332, 319–322, 363–366, 346

[56] References Cited

U.S. PATENT DOCUMENTS

| | | | |
|---|---|---|---|
| Re. 32,354 | 2/1987 | Savage | 222/81 |
| 4,699,188 | 10/1987 | Baker et al. | 141/18 |
| 4,874,023 | 10/1989 | Ulm | 141/346 |
| 4,991,635 | 2/1991 | Ulm | 141/365 X |
| 5,029,624 | 7/1991 | McCunn et al. | 141/346 |
| 5,104,003 | 4/1992 | Stecoza | 222/185 X |
| 5,121,778 | 6/1992 | Baker et al. | 141/319 |
| 5,222,530 | 6/1993 | Baker et al. | 141/18 |
| 5,222,531 | 6/1993 | Baker et al. | 141/18 |
| 5,273,083 | 12/1993 | Burrows | 141/18 |
| 5,284,188 | 2/1994 | Baker et al. | 141/18 |
| 5,289,854 | 3/1994 | Baker et al. | 141/18 |
| 5,289,855 | 3/1994 | Baker et al. | 141/18 |
| 5,295,518 | 3/1994 | Baker et al. | 141/18 |
| 5,295,519 | 3/1994 | Baker et al. | 141/18 |

OTHER PUBLICATIONS

Waterguard Assembly Instructions, (Oasis Models), Ebco Manufacturing Company, Columbus, Ohio.

*Primary Examiner*—Kevin P. Shaver

*Attorney, Agent, or Firm*—Fish & Neave; Robert R. Jackson

[57] ABSTRACT

An apparatus is provided for adapting a liquid dispenser to accept a liquid container, regardless of the container's closure. The adapter utilizes a flexible fitting and/or a cammed fitting which allows it to securely fit a large number of dispensers. Also, the adapter utilizes a releasable detent connection which allows the adapter to be easily installed and removed from the dispenser.

14 Claims, 8 Drawing Sheets

UNIVERSAL ADAPTER FOR LIQUID DISPENSERS

BACKGROUND OF THE INVENTION

This invention relates to an adapter for liquid dispensers. More particularly, this invention relates to a universal adapter which can easily mount to and dismount from a large variety of liquid dispensers. The adapter allows the dispenser on which it is mounted to accept a variety of liquid containers, regardless of the closure on the container.

Liquid dispensers, particularly water coolers, are well known in the art. These dispensers accept a container of liquid which is first inverted and then placed into the dispenser. The liquid empties from the container into a reservoir in the dispenser, from which it is dispensed. A wide variety of liquid dispensers currently exist. For example, porcelain crock dispensers are available which are supported on a stand. These dispensers do not cool nor warm the liquid. Free standing dispensers are also available. The free standing dispensers have means for cooling and/or heating the liquid. Thus dispensers are available which dispense hot liquid, liquid at room temperature, or cold liquid, or some combination of these. Examples of free-standing liquid dispensers currently on the market are: the KELJAC ROOM-TEMPERATURE dispenser; the CORDLEY H. V. dispenser; the CORDLEY dispenser; the SUNROC dispenser; the NEW EBCO dispenser; and the EBCO dispenser.

Liquid containers which are used with the dispensers generally come in 3, 5, or 6 gallon sizes. The containers use basically one of two types of closures, either non-resealable or resealable. Non-resealable closures require the seal on the container to be broken prior to the container being inverted and placed into the dispenser.

The second type of closure is a resealable closure. These closures allow a container to be loaded and unloaded into the dispenser without liquid escaping from the container. This is because the container remains sealed when it is inverted and placed onto the dispenser with the closure sealed. The seal is broken through the use of a probe which sits in the reservoir of the dispenser. The probe fits into the closure, engages and breaks the seal. Liquid is dispensed into the reservoir through apertures in the probe. When the container is unloaded from the dispenser the closure disengages from the probe and reseals the container so that the container is sealed upon removal.

Not all liquid dispensers can accept the containers with the resealable closures because many dispensers are not equipped with a probe which will engage with the closure.

Two adapters, the Ebtech Waterguard System, and the Elkay Watersafe System are available which mount onto some existing dispensers to allow them to accept resealable containers. These systems include a probe which, when properly installed, fits into the reservoir of the dispenser and allows the dispenser to accept resealable liquid containers. However, these systems cannot be mounted onto a number of liquid dispensers. Thus a need exists for a universal adapter which is capable of mounting onto a large variety of dispensers currently on the market.

To insure the quality of the fluid being dispensed from a fluid dispenser, both the adapter and the dispenser should be cleaned periodically. In particular the reservoir which receives the liquid from the inverted container must be kept clean. This may be done by the user or by the company which provides the dispenser. Also, from time to time, the user may have the dispenser cleaned and refurbished for aesthetic purposes. In both instances it is necessary to have access to the reservoir of the dispenser. Since the adapter fits into the reservoir of the dispenser it is necessary that the adapter be easily removable so that the adapter and the dispenser may be cleaned, and the dispenser refurbished.

The Waterguard and Watersafe systems use a rubber gasket to secure the adapter in the dispenser. However, there is no way to release the tension on the gasket so as to allow the adapter to be removed from the system. Thus these adapters cannot be easily removed from the dispenser to allow for cleaning and refurbishing. Often times removal of these adapters causes damage to the dispenser.

Thus a need exists for a product which can easily be mounted onto a wide variety of existing dispensers to allow them to accept both re-sealable and non-resealable containers, and which is easily removable from the dispensers so that they may be easily cleaned and refurbished without doing damage to the dispensers.

SUMMARY OF THE INVENTION

It is an object of the present invention to provide an apparatus which adapts existing liquid dispensers to accept both resealable and non-resealable containers.

It is also an object of this invention to provide an apparatus which adapts a variety of liquid dispensers to accept both resealable and non-resealable containers.

It is also an object of this invention to provide an apparatus which easily mounts onto the liquid dispenser.

It is a further object of this invention to provide an apparatus which is easily removable from the dispenser.

The disadvantages and limitations of previous adapters are overcome by the present invention, which is an apparatus which adapts a variety of liquid dispensers to accept both resealable and non-resealable containers, and which can be easily removed to allow for cleaning and refurbishing of the apparatus and dispenser.

The present invention is a universal adapter which has a unique design which combines a flexible multi-prong fitting with a cam ring to provide an adapter which fits securely within a variety of liquid dispensers. Moreover, the present invention utilizes a turn and lock/unlock connection which allows for the adapter to be easily installed and removed from the dispenser.

More specifically, the adapter utilizes a tapered funnel. The tapered base of the funnel connects to a multi-prong probe with a detent connection. The wide mouth of the funnel rests on an annular adapter ring which sits on the top of the liquid dispenser such that the base of the funnel and connected probe are suspended within the reservoir of the dispenser. A cam ring surrounds the external wall of the funnel such that it sits within the prongs of the probe. When the assembled adapter is placed into a liquid dispenser, stress is typically placed on the prongs of the probe by the walls of the reservoir of the dispenser. The funnel is then turned in a tightening direction so as to cause the base of the funnel to connect to the probe via a detent connection. The turning if the funnel in the tightening direction simultaneously causes the cam ring to exert additional stress on the prongs of the probe so as to force the prongs more securely against the side walls of the reservoir. This ensures that the adapter is secure within the dispenser.

Once the adapter is secure, a container of liquid may be inverted and placed into the funnel regardless of the closure on the container. A resealable closure will easily engage with the probe of the adapter so that the liquid may dispense into the reservoir of the dispenser. The mouth of a non-resealable closure will fit over the probe so that the liquid may dispense into the reservoir of the dispenser.

The adapter may be easily removed from the dispenser by turning the funnel opposite the tightening direction and gently pulling the funnel from the dispenser. The loosening of the funnel causes the cam ring to reduce stress on the prongs while simultaneously releasing the detent connection between the funnel and the probe. Once the funnel is removed from the dispenser, the probe may thereafter be removed from the dispenser. In this way, the adapter may be removed from the dispenser to allow both the adapter and the dispenser to be cleaned without harming the dispenser.

BRIEF DESCRIPTION OF THE INVENTION

The above and other objects and advantages of the invention will be apparent upon consideration of the following detailed description, taken in conjunction with the accompanying drawings, in which like reference characters refer to similar parts throughout, and which:

DETAILED DESCRIPTION OF THE PREFERRED EMBODIMENTS

Figure 1:
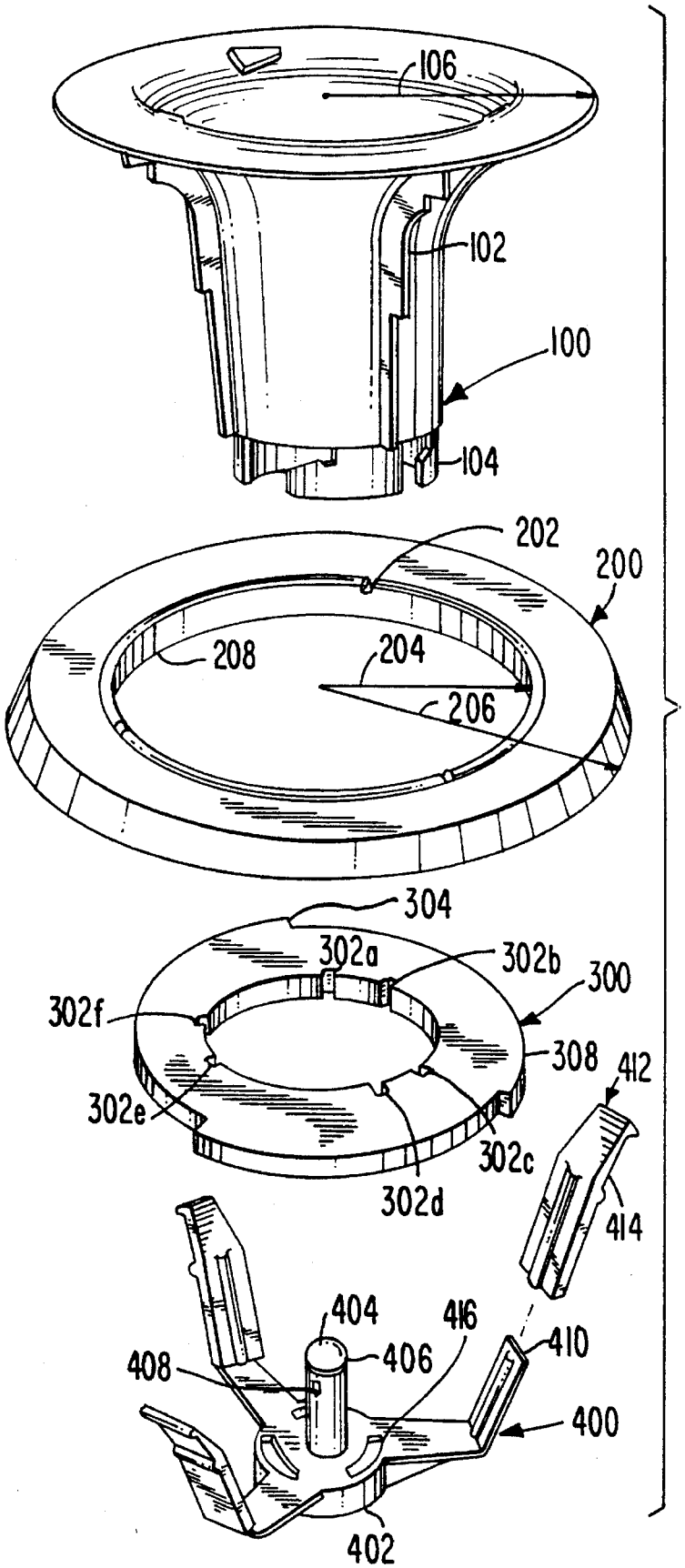
FIG. 1 is an exploded perspective view of an illustrative embodiment of the adapter of the present invention.

Referring to FIG. 1, the assembly of the claimed adapter is described. The claimed adapter is assembled from a funnel 100, an adapter ring 200, a cam ring 300, and a probe 400.

The funnel 100 is tapered with narrow extensions 102 which extend radially along the length of the funnel's exterior wall and which fit into notches 202,302, in the adapter ring and cam ring.

The adapter ring 200 is an annular ring with an interior radius 204 which is smaller than that of the wide end 106 of the funnel and an exterior radius 206 which is larger than that of the funnel 106. This allows the adapter ring 200 to fit annularly about the funnel 100 with the funnel partly touching and overlapping the adapter ring. The inner surface 208 of the adapter has three notches 202, which each accept a respective one of the extensions 102 of the funnel.

The cam ring 300 has six notches 302 *a–f*, along its inner surface 306, which can be viewed as two sets of three. Each of these notches 302, may accept one of the extensions 102 of the funnel 100. This allows the cam ring 300 to be placed in one of two rotational positions about the funnel. The "C" position allows the cam ring 300 to exert the most stress on the prongs 410 of the probe 400. The cam ring is placed in this position by locating the cam ring so that the notches 302 *a, c* and *e* accept the extensions 102 of the funnel. The standard position of the cam ring allows the cam ring to exert less stress on the prongs of the probe. In the standard position, notches 302 *b, d* and *f* accept the extensions 102 of the funnel 100. The outer surface 308 of the cam ring is a cammed surface which makes contact with the prongs 410 and sleeves 412 of probe 400 of the adapter.

The probe 400 of the assembly has a circular base 402. In the center of the base, there is a cylindrical protrusion 404 which extends in the direction of the longitudinal axis of the assembly. The protrusion 404 may be divided into two sections. One section may be ⅔ of the internal area of the protrusion 404 and the other section may be ⅓ of the internal area of the protrusion 404. Fluid from a container inverted over the protrusion may flow through the larger section of the protrusion through an aperture 408 near the tip of the protrusion. Air may flow through the smaller section of the protrusion through a second aperture 408, near the tip of the protrusion. The tip of the protrusion may have a lip 406 around the entire circumference of the cylinder 406. This lip 406 may engage a resealable cap on a liquid container. Extending radially from the base 402 are three identical, semi-rigid prongs 410. Each of these prongs extends radially from the base and then turns upward in the direction of the longitudinal axis of the assembly. Each of the prongs can accept a removable sleeve 412. The sleeve fits over the part of the prong which is inclined upward. The base of the probe has three apertures 416 which accept the cam-guided legs 104 which extend from the base of the funnel 100. The legs of the funnel attach to and detach from the probe with a detent connection and release when legs 104 are inserted in apertures 416 and the funnel is rotated relative to the probe.

All of the parts of the apparatus except sleeves 412 are preferably made of plastic. Sleeves 412 are preferably made of a soft synthetic rubber.

The apparatus is typically assembled by placing the funnel 100 inside the adapter ring 200 such that each notch 202 of the adapter ring 200 receives an extension 102 of the funnel 100. Next, the cam ring 300 is positioned about the funnel 100. Depending upon the liquid dispenser, the cam ring 300 may be omitted, or may be placed in one of two rotational positions about the funnel 100 so that one of the two sets of notches 302 in the cam ring receives the extensions 102 of the funnel 100. Then the funnel 100 with adapter ring 200 and cam ring 300 (if necessary) surrounding it is placed into the probe 400 such that the apertures 416 in the base 402 of the probe 400 receive the legs 104 of the funnel 100. The apparatus thus assembled is then placed into the top of the liquid dispenser so that the adapter ring 200 rests on the top of the dispenser and the assembly hangs suspended from the adapter ring 200 such that the base 402 of the probe 400 extends into the reservoir of the dispenser. The funnel 100 is then turned clockwise which forces the cam-guided legs 104 of the funnel 100 to lock into the base 402 of the probe 400 with a releasable detent connection. In addition, in the situation where the cam ring 300 is used, turning the funnel 100 clockwise causes the cam ring 300 to exert a radially outwardly directed force on the prongs 410 of the probe 400, thus securing the apparatus in the liquid dispenser. In some coolers, the flexible sleeves 412 of the probe 400 are sufficient to secure the adapter to the dispenser.

The adapter may be easily removed from the dispenser by simply turning the funnel 100 of the secured adapter counter-clockwise. This movement releases the pressure exerted by the cam ring 300 on the prongs 410 of the probe 400, and simultaneously releases the detent connection between the funnel 100 and the probe 400. The funnel may then be removed by gently pulling up on the funnel so as to remove the legs 104 of the funnel 100 from the apertures 416 in the probe 400.

The novel design of the adapter which enables the adapter to fit a wide variety of liquid dispensers is further demonstrated in FIGS. 2–8, which are cross-sectional views which illustrate how the adapter fits various types of dispensers.

Figure 2:
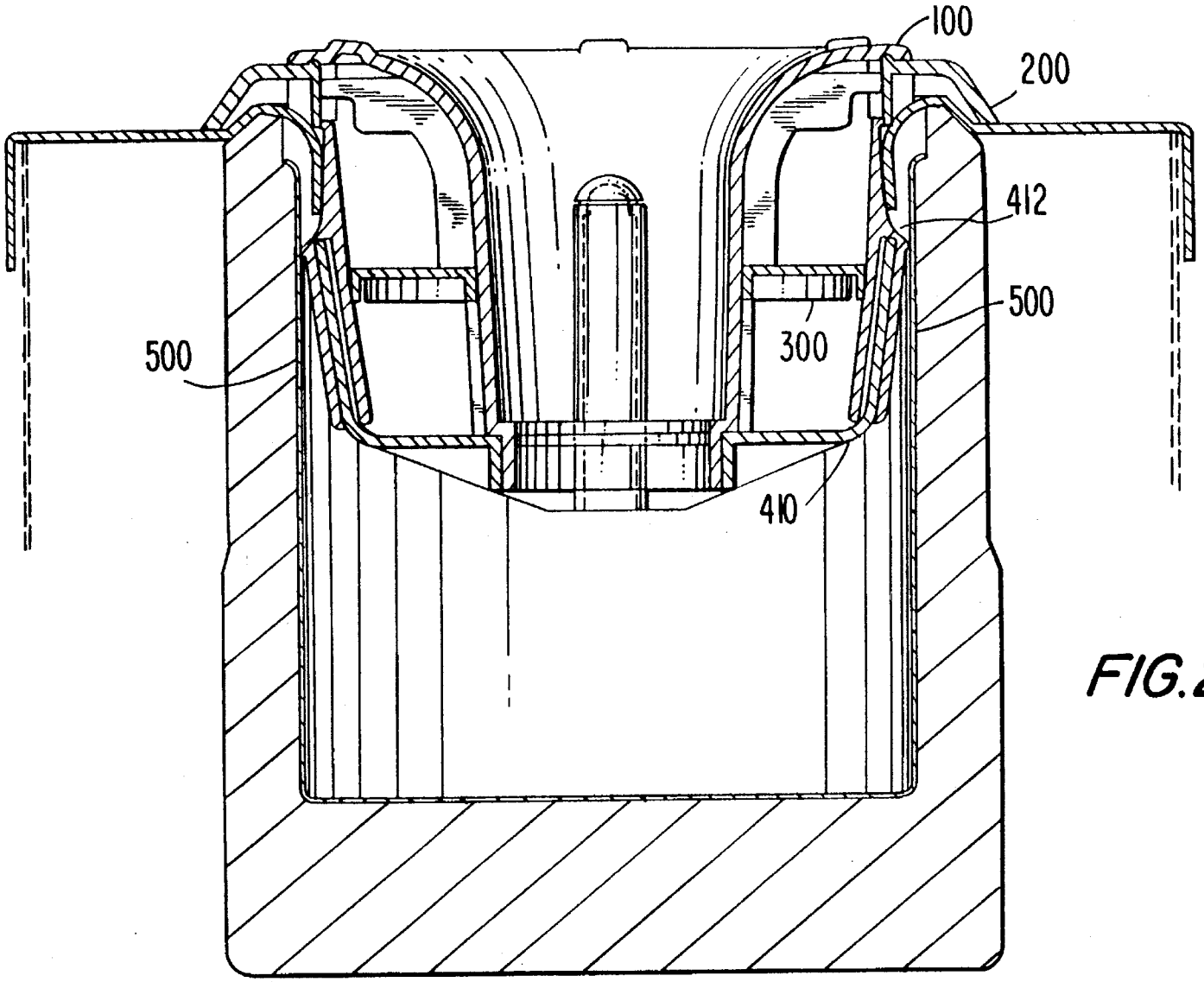
FIG. 2 is a cross-sectional view of the adapter of FIG. 1 as it appears fitted into a conventional CORDLEY dispenser.
Figure 3:
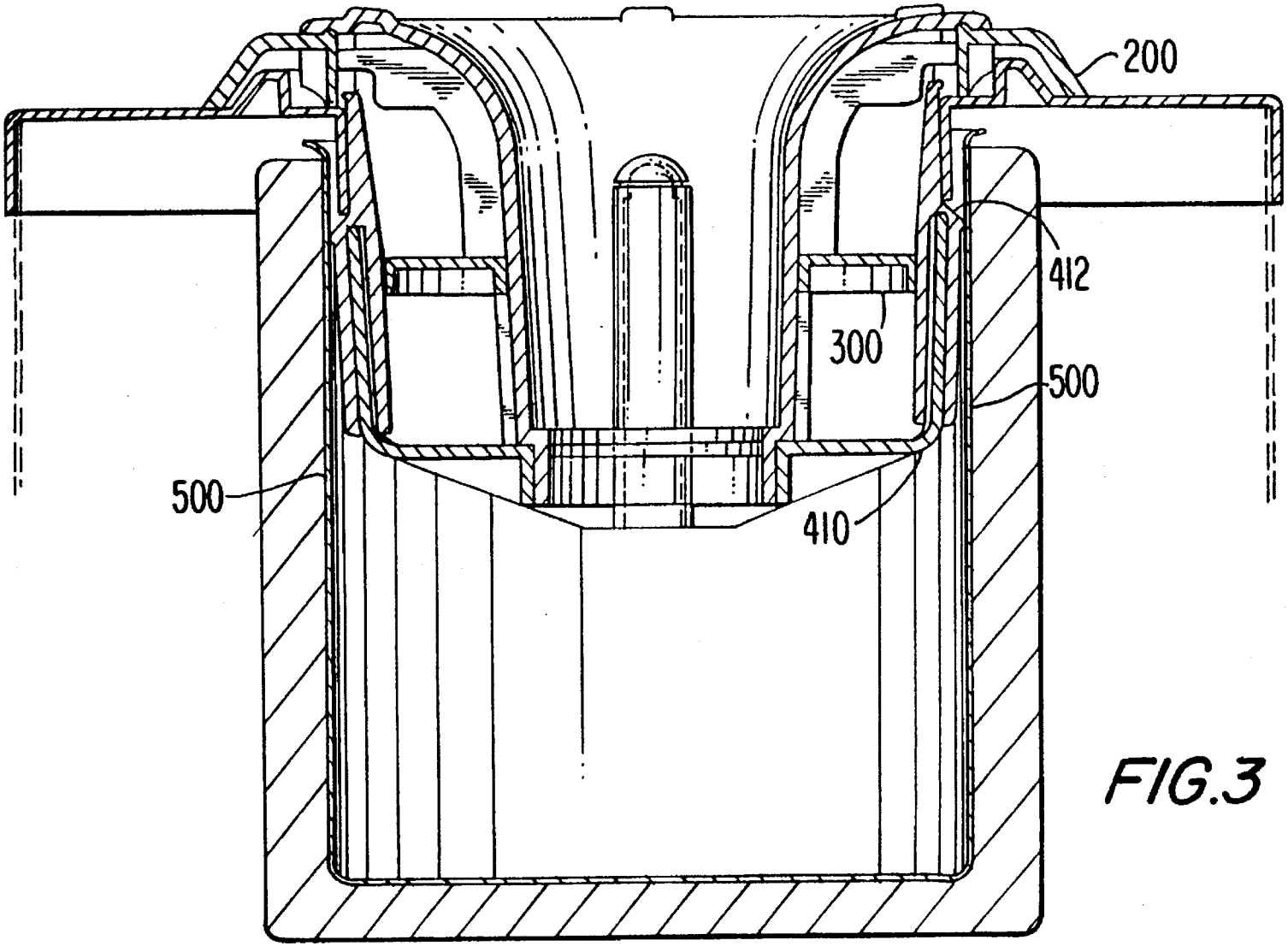
FIG. 3 is a cross-sectional view of the adapter of FIG. 1 as it appears fitted into a conventional SUNROC dispenser.
Figure 4:
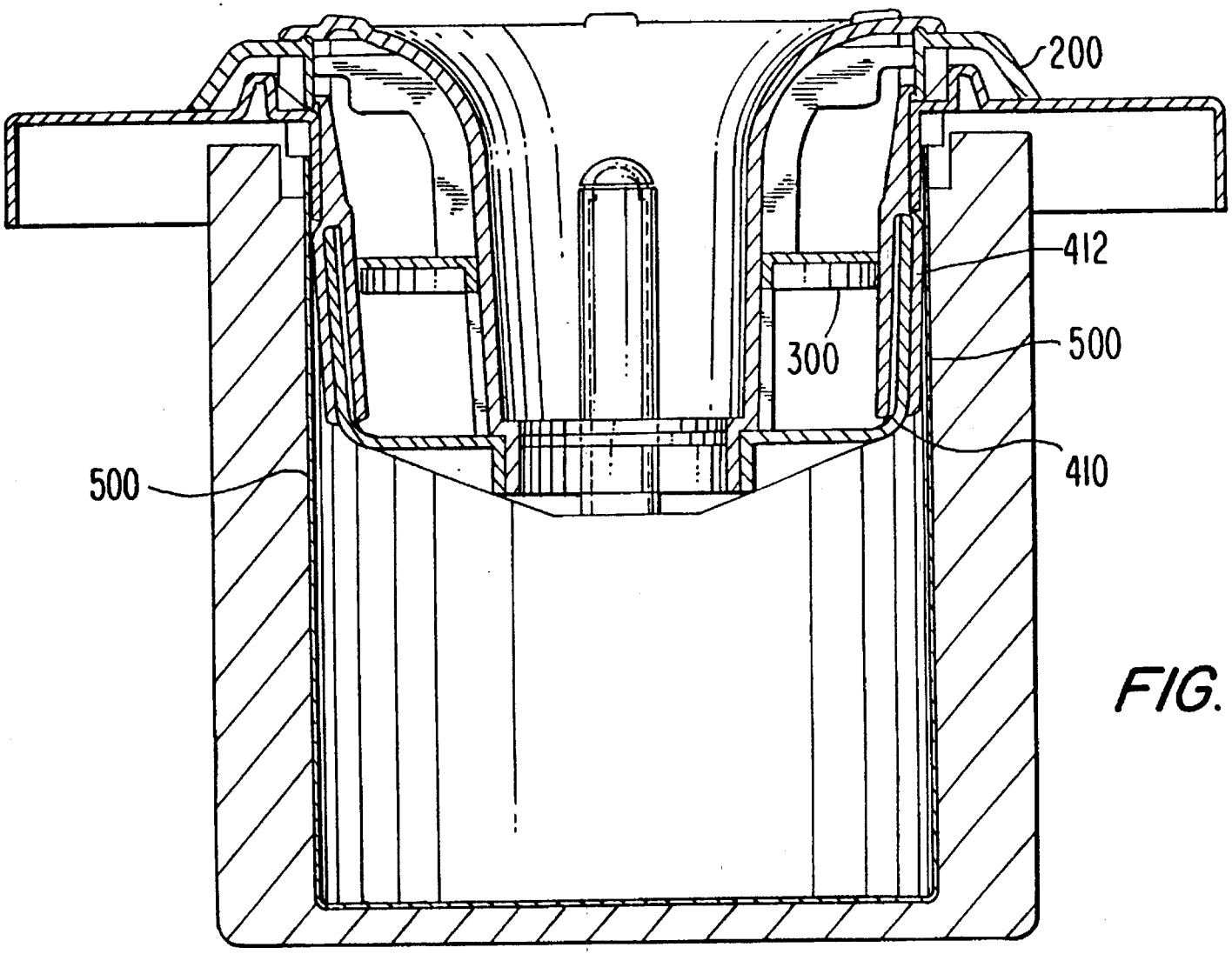
FIG. 4 is a cross-sectional view of the adapter of FIG. 1 as it appears fitted into a conventional EBCO dispenser.
Figure 5:
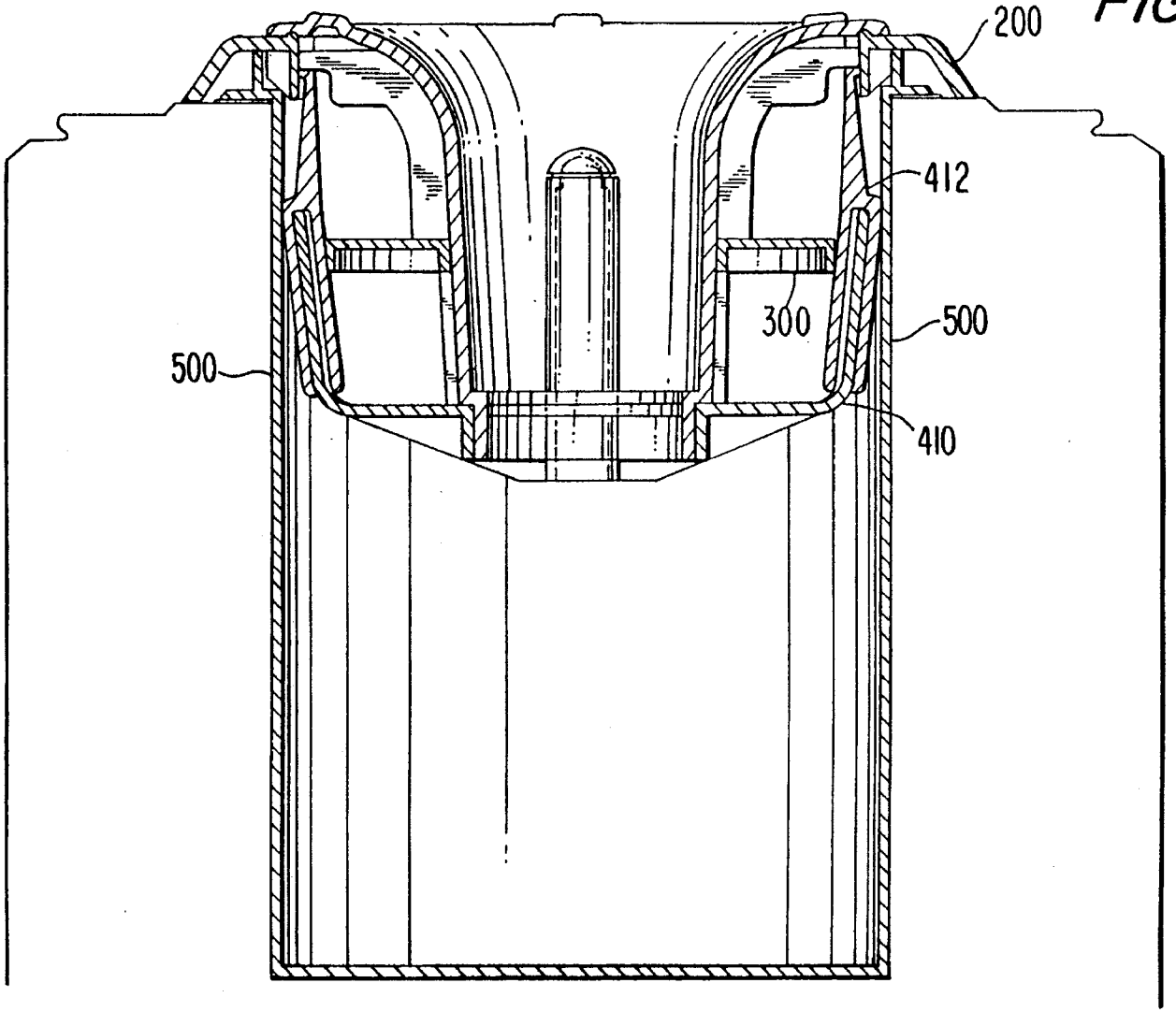
FIG. 5 is a cross-sectional view of the adapter of FIG. 1 as it appears fitted into a conventional NEW EBCO dispenser.

FIGS. 2–5 are cross-sectional views which illustrate how the adapter fits dispensers utilizing the adapter ring 200 and the cam ring 300. As illustrated in each of these views, the entire assembly hangs suspended from the adapter ring 200. The sleeves 412 on the prongs 410 engage the sides of the reservoir 500. The prongs 410 and accompanying sleeves 412 are held secure against the sides of the reservoir by the cam ring 300. FIGS. 2 and 5 illustrate the cam ring 300 in the "C" position relative to the funnel and probe, whereas FIGS. 3 and 4 illustrate the cam ring 300 in the standard position relative to the funnel and probe. A comparison of the figures demonstrates that the C position of the cam ring 300 (illustrated in FIGS. 2 and 5) forces the prongs 410 and sleeves 412 to deflect further outward than the standard position of the cam ring 300 (illustrated in FIGS. 3 and 4). This feature allows the adapter to fit securely in dispensers with different diameter reservoirs.

Figure 6:
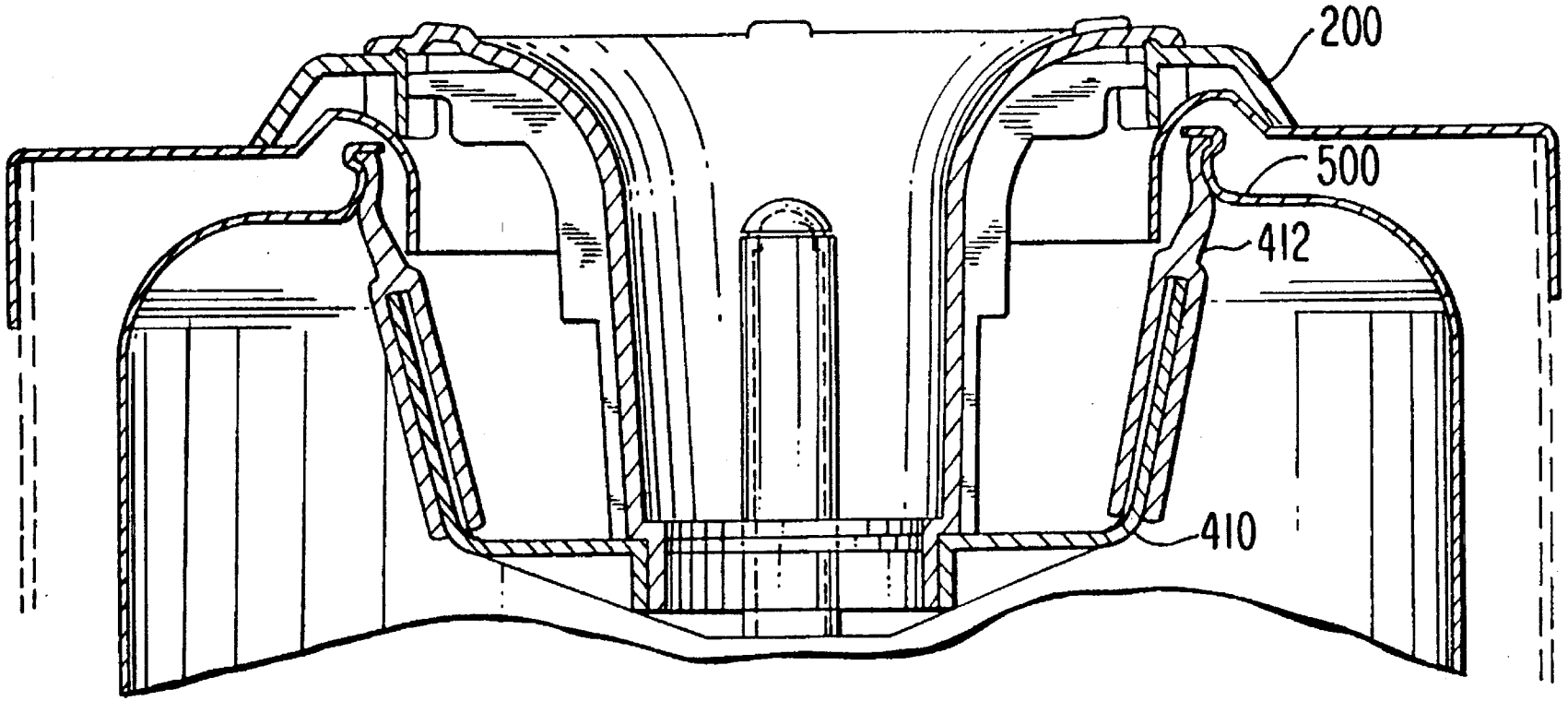
FIG. 6 is a cross-sectional view of the adapter of FIG. 1 as it appears fitted into a conventional CORDLEY H. V. dispenser.

FIG. 6 is a cross-sectional view which illustrates how the adapter fits a dispenser utilizing the adapter ring 200 but not the cam ring. As in FIGS. 2–5, the entire assembly hangs suspended from the adapter ring 200. Unlike the dispensers illustrated in FIGS. 2–5, the reservoir of the dispenser of FIG. 6 is larger in circumference than the reservoirs illustrated in FIGS. 2–5. In a reservoir this wide, the assembly cannot be secured within the dispenser by the force of the cam ring against the prongs. Rather, the sleeves 412 of the prongs 410 engage under a radially inwardly directed lip near the top of the reservoir 500 and thereby secure the assembly within the reservoir.

Figure 7:
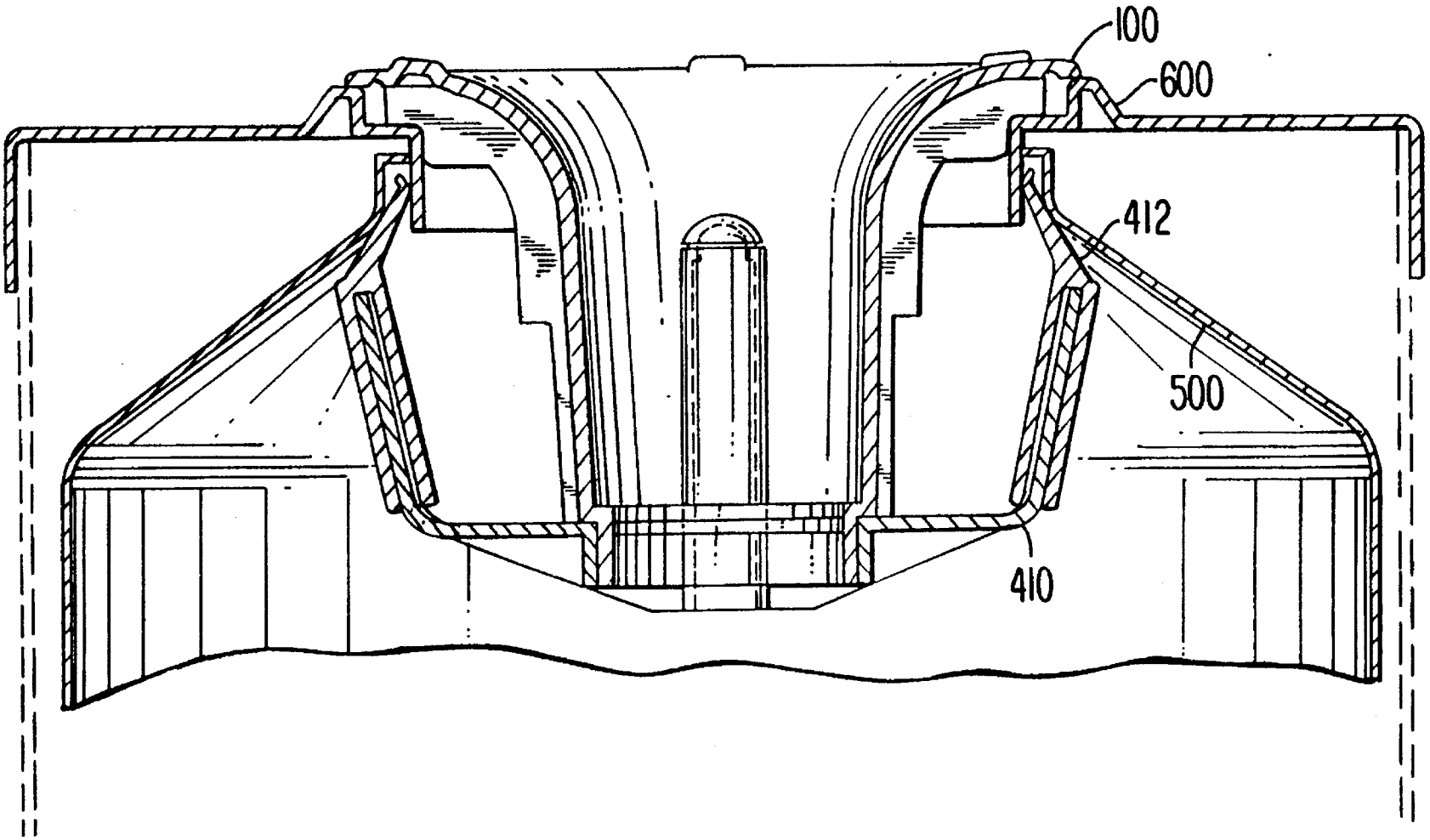
FIG. 7 is a cross-sectional view of the adapter of FIG. 1 as it appears fitted into a conventional KELJAC ROOM TEMPERATURE dispenser.

FIG. 7 is a cross-sectional view which illustrates how the adapter fits a dispenser without the use of the adapter ring or the cam ring. The dispenser illustrated in FIG. 7 has a lip 600 around the circumference of the opening into the reservoir which the funnel 100 may suspend from. Therefore the adapter ring is not necessary. Thus, the assembly hangs suspended from the lip 600 of the dispenser. The sleeves 412 engage the sides of the reservoir 500 and secure the assembly within the reservoir, as is illustrated in FIG. 6.

Figure 8:
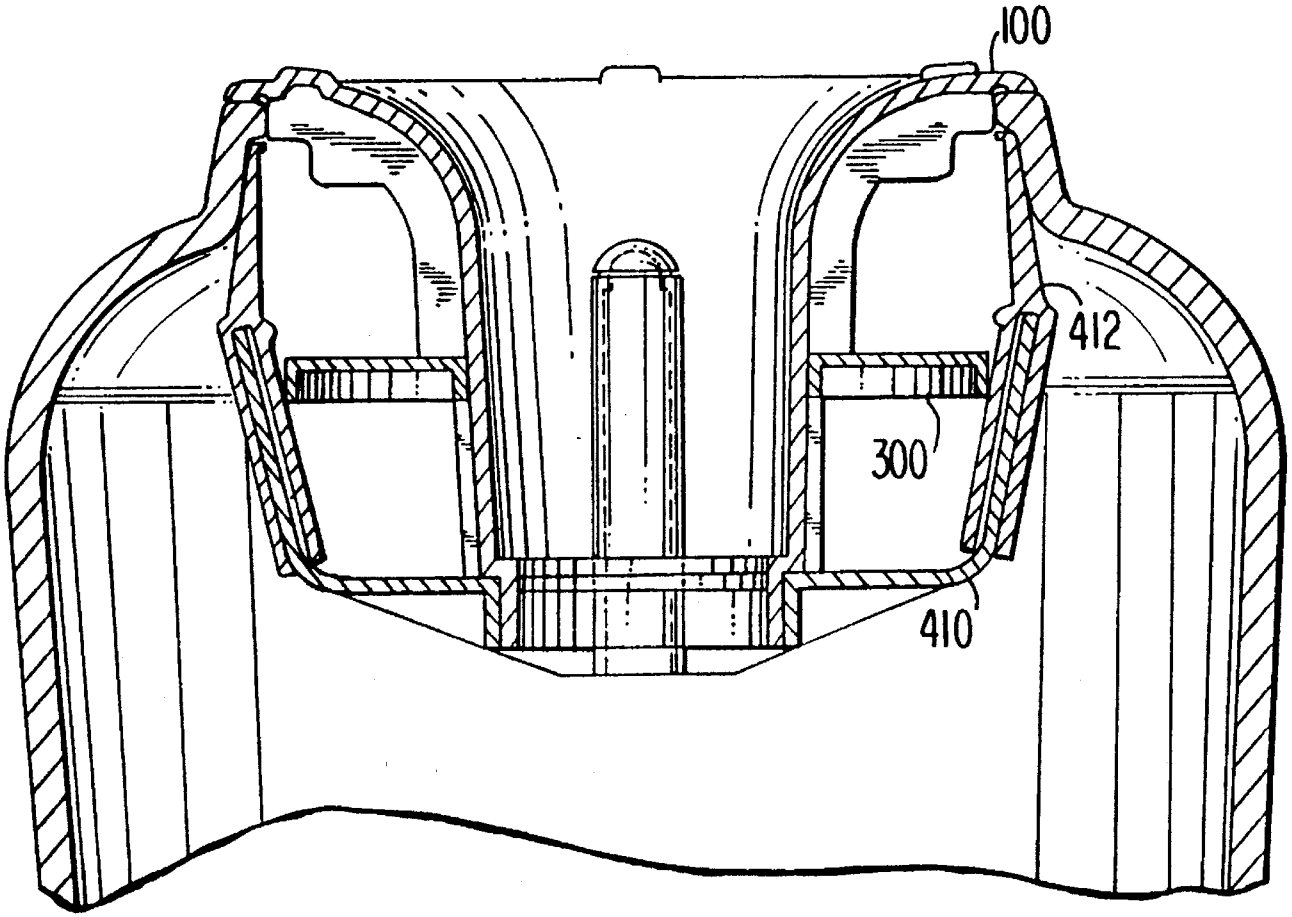
FIG. 8 is a cross-sectional view of the adapter of FIG. 1 as it appears fitted into a crock dispenser.

FIG. 8 is a cross-sectional view which illustrates how the adapter fits a dispenser using the cam ring 300, but not the adapter ring. The dispenser illustrated in FIG. 8 is a crock dispenser. The opening into the reservoir of this dispenser is not wide enough to require the adapter ring. However, the funnel 100 is designed to allow the assembly to hang suspended from the funnel 100. The sleeves 412 are repositioned on the prongs 410 in an orientation opposite of that illustrated in FIGS. 1–7. This allows the sleeves 412 of the prongs 410 engage the sides of the reservoir 500 and secure the assembly in the reservoir.

Thus, a universal adapter for liquid dispensers is provided. Although various embodiments of the invention have been disclosed, with various components interconnected with other components, persons skilled in the art will appreciate that it may not be necessary for such connections to be direct and that additional components may be interconnected between the shown connections without departing from the spirit of the invention. Persons skilled in the art will appreciate that the present invention can be practiced by other than the described embodiments, which are presented for purposes of illustration, and not of limitation, and the present invention is limited only by the claims which follow.

What is claimed is:

1. An apparatus for adapting a liquid dispenser to accept a liquid container, regardless of the container's closure, comprising:

support means for receiving and supporting the liquid container;

dispensing means for accepting the closure of the liquid container;

cooperating cam and cam follower connection means for joining the support means and the dispensing means in a manner which allows them to be easily connected and disconnected by turning the support means less than a full rotation; and a detent for releasably engaging after the cam follower has traversed the cam to releasably prevent the cam follower from oppositely traversing said cam.

2. An apparatus for adapting a liquid dispenser to accept a liquid container, regardless of the container's closure, comprising:

support means for receiving and supporting the liquid container;

dispensing means joined to the support means for accepting the closure of the liquid container; and flexible engagement means for securing the joined support means and dispensing means to the dispenser, said engagement means comprising a multi-pronged fitting in which each prong extends in a direction radial from the dispensing means.

3. The apparatus of claim 2, wherein each of the prongs is flexible independent of the others.

4. An apparatus for adapting a liquid dispenser to accept a liquid container, regardless of the container's closure, comprising:

support means for receiving and supporting the liquid container;

dispensing means joined to the support means for accepting the closure of the liquid container; and flexible engagement means for securing the joined support means and dispensing means to the dispenser, said flexible engagement means comprising a multi-pronged fitting in which each of the prongs are flexible independent of the others and wherein each of the prongs receives a flexible sleeve which partially covers the prong and extends beyond the prong.

5. An apparatus for adapting a liquid dispenser to accept a liquid container, regardless of the container's closure, comprising:

support means for receiving and supporting the liquid container;

dispensing means joined to the support means for accepting the closure of the liquid container;

flexible engagement means for engaging the joined support means and dispensing means with the dispenser, said engagement means comprising a multi-pronged fitting in which each prong extends in a direction radial from the dispensing means; and cammed securing means, mounted on the support means and having a cam surface for engaging the prongs of the multi-prong fitting such that the turning of the support means in a direction relative to the dispensing means causes the cam surface to push the prongs of the engagement means in a radial direction relative to the dispensing means, thereby securing the joined support means and dispensing means to the dispenser.

6. The apparatus of claim 5, wherein the cammed securing means comprises an annular ring with a cammed edge.

7. The apparatus of claim 6, wherein the annular ring can occupy one of multiple positions about the support means.

8. An apparatus for adapting a liquid dispenser to accept a liquid container, regardless of the container's closure, comprising:

a support structure for receiving and supporting the liquid container;

a dispenser for accepting the closure of the liquid container;

a cooperating cam and cam follower connector for joining the support structure and the dispenser in a manner which allows them to be easily connected and disconnected by turning the support structure less than a full rotation; and a detent for releasably engaging after the cam follower has traversed the cam to releasably prevent the cam follower from oppositely traversing said cam.

9. An apparatus for adapting a liquid dispenser to accept a liquid container, regardless of the container's closure, comprising:

a support structure for receiving and supporting the liquid container;

a dispenser joined to the support structure for accepting the closure of the liquid container; and a flexible engagement structure for securing the joined support structure and dispenser to the liquid dispenser, said engagement structure comprising a multi-pronged fitting in which each prong extends in a direction radial from the dispenser.

10. The apparatus of claim 9 wherein each of the prongs is flexible independent of the others.

11. An apparatus for adapting a liquid dispenser to accept a liquid container, regardless of the container's closure, comprising:

a support structure for receiving and supporting the liquid container;

a dispenser joined to the support structure for accepting the closure of the liquid container; and a flexible engagement structure for securing the joined support structure and dispenser to the liquid dispenser, said flexible engagement structure comprising a multi-pronged fitting in which each of the prongs is flexible independent of the others and wherein each of the prongs receives a flexible sleeve which partially covers the prong and extends beyond the prong.

12. An apparatus for adapting a liquid dispenser to accept a liquid container, regardless of the container's closure, comprising:

a support structure for receiving and supporting the liquid container;

a dispenser joined to the support structure for accepting the closure of the liquid container;

a flexible engagement structure for engaging the joined support structure and dispenser with the liquid dispenser, said engagement structure comprising a multi-pronged fitting in which each prong extends in a direction radial from the dispenser; and a cammed securing structure, mounted on the support structure and having a cam surface for engaging the prongs of the multi-prong fitting such that the turning of the support structure in a direction relative to the dispenser causes the cam surface to push the prongs of the engagement structure in a radial direction relative to the dispenser, thereby securing the joined support structure and dispenser to the liquid dispenser.

13. The apparatus of claim 12, wherein the cammed securing structure comprises an annular ring with a cam surface.

14. The apparatus of claim 13, wherein the annular ring can occupy one of multiple positions about the support structure.

* * * * *